US007189096B2

(12) United States Patent
Miksche et al.

(10) Patent No.: US 7,189,096 B2
(45) Date of Patent: Mar. 13, 2007

(54) LOCKABLE PLUG-TYPE CONNECTOR

(75) Inventors: Dieter Miksche, Gadernheim (DE); Volker Seipel, Bensheim (DE); Alexandre Auble, Pacy-sur-Eure (FR); Xavier Rouillard, Ermont (FR); Jerome Drouhot, Colombos (FR)

(73) Assignee: Tyco Electronics AMP GmbH, Bensheim (DE)

( * ) Notice: Subject to any disclaimer, the term of this patent is extended or adjusted under 35 U.S.C. 154(b) by 0 days.

(21) Appl. No.: 11/168,734

(22) Filed: Jun. 28, 2005

(65) Prior Publication Data

US 2006/0057880 A1 Mar. 16, 2006

(30) Foreign Application Priority Data

Jun. 30, 2004 (DE) ..... 10 2004 031 464

(51) Int. Cl.
*H01R 16/27* (2006.01)

(52) U.S. Cl. ..... 439/352

(58) Field of Classification Search ..... 439/352, 439/595

See application file for complete search history.

(56) References Cited

U.S. PATENT DOCUMENTS

| | | | | |
|---|---|---|---|---|
| 5,591,041 | A * | 1/1997 | Cecil et al. | 439/352 |
| 5,863,214 | A * | 1/1999 | Hanak | 439/352 |
| 6,217,388 | B1 * | 4/2001 | Francis | 439/352 |
| 6,287,139 | B1 * | 9/2001 | Seko et al. | 439/352 |
| 6,328,589 | B1 * | 12/2001 | Annecke | 439/352 |
| 6,435,894 | B2 * | 8/2002 | Little et al. | 439/352 |
| 6,743,051 | B2 * | 6/2004 | Hayashi | 439/352 |
| 2001/0007801 | A1 * | 7/2001 | Nimura | 439/352 |
| 2004/0248454 | A1 * | 12/2004 | Gunreben et al. | 439/352 |

FOREIGN PATENT DOCUMENTS

| | | | |
|---|---|---|---|
| DE | 198 40 726 | C2 | 9/2000 |
| DE | 102 24 757 | B3 | 1/2004 |
| DE | 202 17 461 | U1 | 4/2004 |
| EP | 1 006 621 | A2 | 6/2000 |
| EP | 1 463 185 | A2 | 9/2004 |
| WO | WO 03/103102 | A1 * | 12/2003 |

* cited by examiner

*Primary Examiner*—Briggitte R. Hammond
(74) *Attorney, Agent, or Firm*—Barley Snyder LLC

(57) ABSTRACT

The invention relates to a lockable plug-type connector, such as for producing an electrical and mechanical connection between an igniter and an electrical control device of an occupant restraining system in motor vehicles. The lockable plug-type connector comprises a connector and a socket for lockably receiving a connecting device located on the connector. The connector substantially comprises a housing with a connecting device and a locking device, a housing cover and a partial covering with locking device. The locking devices provide mechanical locking of the connector in the socket. The locking device of the partial covering are formed by at least one locking tongue which is arranged on the edge of at least one recess on the partial covering.

15 Claims, 6 Drawing Sheets

LOCKABLE PLUG-TYPE CONNECTOR

FIELD OF THE INVENTION

The invention relates to a lockable plug-type connector, in particular for producing an electrical and mechanical connection between an igniter and an electrical control device of an occupant restraining system in motor vehicles.

BACKGROUND

Plug-type connectors for detachable mechanical connection and locking of electrical connections are known in numerous embodiments. The requirements of the securing properties of the plug-type connector are extremely high, particularly in safety-critical connections, such as the electrical connection between an igniter, for example of an airbag and/or a belt tensioning device, and an electrical control device of an occupant restraining system in motor vehicles. It should not, under any circumstances, be possible for a plug-connector of this type, once it has been connected for example during assembly of the motor vehicle, to be able to independently detach again, not even as a result of impacts, jolts, vibrations or similar mechanical effects.

To achieve a high holding force in plug-type connectors, these connectors comprise variously configured blocking or locking devices. High demands with respect to flexibility and rigidity are placed on these devices. On the one hand, it must be possible to produce the plug-in connection, in other words, it must be possible to introduce the connecting device, projecting from the connector housing, into the corresponding openings of the socket. If the connector is in the correct position, i.e. if the connecting device is inserted to a sufficient depth into the socket and, for example in the case of an electrical plug-type connector, an electrical contact is produced, a locking device should produce such a high holding force that detachment of the connector is no longer possible or is only possible by applying an appropriately high force or by mechanical unlocking.

Lockable plug-type connectors frequently comprise a flexible connecting device and a rigid locking device which are constructed separately from each other. In the case of such plug-type connectors the actual plug-in connection is produced in that the connecting device projecting on the connector housing is introduced into the socket, wherein the connecting device can, on the one hand, produce a directional guide and, on the other hand, can comprise a mechanical arresting and/or securing device. Only thereafter, for example as a result of activation of a blocking key, displacement of a slide or another type of mechanical movement, is locking of the plug-type connector implemented in that a more rigid securing element is introduced which either provides for secure retention of the connector in the socket on its own or the still relatively slight holding force of the plug-type connector, produced by a mechanical arresting and/or securing device on the connecting device, is assisted and the overall holding force thus increased.

An example of a plug-in connector of this type is described in DE 102 02 920 A1.

Plug-type connectors are also known which likewise have the requisite holding properties and in which no additional mechanical action on a plug-type connector portion is required after insertion into the socket. Mating is possible in such plug-type connectors in the presence of any flexible and less flexible components of the locking device. The secure, locked connection is produced by the action of insertion; no further intervention is necessary. This reduces the assembly time and can also prevent application of mechanical locking from being forgotten.

However, a drawback of connectors of this type is that, on insertion of the connector into the socket, an insertion force has to be applied which is directed counter to the holding force in the closed connector and which corresponds in size to the holding force. A high insertion force inevitably results with a high holding force in systems of this type.

SUMMARY

A locking plug-type connector is provided, which can be used, in particular, for producing an electrical and mechanical connection between an igniter and an electrical control device of an occupant restraining systems in motor vehicles, comprises a connector housing, for example for receiving electrical cables, and spring contacts electrically connected thereto, and a socket for lockably receiving a connecting device projecting on the housing and which also, for example, provides contact pins for producing an electrical connection to the spring contacts. The connector housing comprises a housing with a connecting device and a locking device, a housing cover and a partial covering with a locking device, the locking devices providing mechanical locking of the connector in the socket.

The locking device of the partial covering is, according to the present invention, formed by at least one locking tongue which is located at the edge of at least one recess on the partial covering.

According to the invention the locking tongues comprise locking noses at their outer end. When the connector is assembled, the noses are located directly behind additional locking noses which are provided on the connecting device projecting on the connector housing. During the insertion operation the locking noses latch into an annular groove in the socket and thus provide secure retention of the connector in the socket.

On insertion of the connector into the socket, the locking tongues have to execute a backwards movement in order to latch into the annular groove. In the previously known connecting devices of the described type, the entire partial covering, or at least the lateral contour of the partial covering, had to also move in the same manner for this purpose. However, the partial covering is rigidly interlocked with the connector housing and is also rigid per se. The large force which has to be applied for insertion of the connector into the socket is thus, at least partially, determined by the rigidity of the partial covering or the cover plate of the partial covering.

According to the present invention, the insertion force of a lockable connecting device of the type described is reduced in that the cover plate of the partial covering is not constructed as a continuous surface but has at least one recess directly adjacent to the at least one locking tongue, which leads to increased mechanical flexibility of the system. The movements of the locking tongues and the movements of the partial covering or the movements of the entire connector are at least partially decoupled from each other hereby. The locking tongues can execute their backwards movement fundamentally more easily as the counter force is much reduced if the additional cover and housing components do not also have be moved against mechanical resistances at the same time.

BRIEF DESCRIPTION OF THE DRAWINGS

The invention will be described hereinafter with reference to preferred embodiments and with reference to the accompanying drawings. Here identical components are fundamentally provided with identical reference numerals. In some cases these will not be repeatedly described. In the drawings.

DETAILED DESCRIPTION OF THE EMBODIMENT(S)

Figure 1:
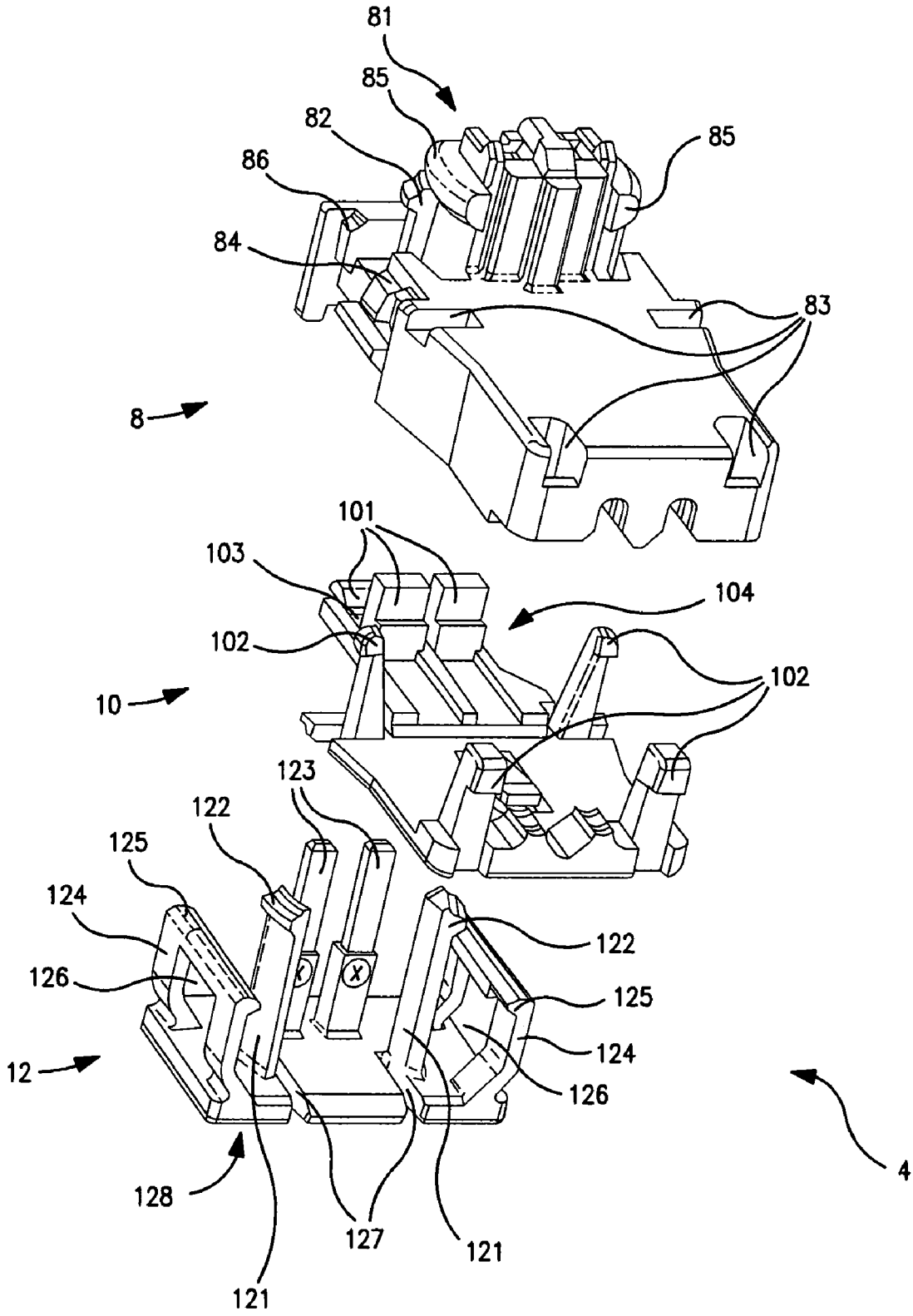
FIG. 1 shows an exploded view of a connector according to an exemplary embodiment of the invention.

FIG. 1 shows an exploded view of a connector 4 which, together with a socket 6 (see FIG. 3), forms a lockable plug-type connector 2 for lockably receiving a connecting device 81 projecting on a housing 8 of the connector 4. The connector 4 can be used, in particular, for producing an electrical and mechanical connection between an igniter and an electrical control device of an occupant restraining system in motor vehicles.

The connector 4 is assembled from a housing 8 with connecting device 81 and locking device 82, a housing cover 10 and a partial covering 12 with two locking tongues 121 which in each case comprise a locking nose 122 at their end. The housing 8 is used, for example, to receive electrical cables and spring contacts electrically connected thereto (not shown). The housing cover 10 comprises insertion tongues 101 and latching hooks 102 which may be pushed into corresponding recesses 83 in the connector housing 8 and be locked there. It is used to protect the elements situated in the housing 8. The guide tongues 123 of the partial covering 12 are introduced into corresponding recesses 103 in the housing cover 10 and guided downwards along appropriately provided insertion tongues 101. In the process, the locking tongues 121 of the partial covering 12 surround the leading narrowed portion 104 of the housing cover 10 and, in the fully inserted state, the locking noses 122 come to rest on the connecting device 81 behind the locking devices 82 and directly above a curved connector element 85. The insertion tongues 101 are slightly curved so their contour matches the contour of the, in principle, round connecting device 81 or the contour of the laterally located, rounded connector elements 85. The locking devices 82 and 122, in cooperation with the connector element 85, jointly provide mechanical locking of the connector 4 in the socket 6. The partial covering 12 also comprises lateral parts 124 which surround the housing cover 10 and the connector housing 8 when the connector 4 is mated and are latched thereto by means of engaging hooks 125 and receptacles 126 for latching hooks 84 and receptacles 86 correspondingly arranged on the housing 8.

The partial covering 12, according to the invention, comprises two slot-shaped recesses 127, extending parallel to each other and in the longitudinal direction of the connector 4, on the backwards-pointing edge of the covering surface 128 of the partial covering 12. The slot-shaped recesses 127 preferably extend to the back edge of the partial covering 12, so the backwards-pointing edge of the partial covering 12 is not continuous. According to the invention, a respective locking tongue 121, of which the flat or slightly curved inner face terminates flush with the outer edge face of the slot-shaped recess 127, is located in the vicinity of the outwardly pointing edges of the slot-shaped recesses 127. However, other embodiments may also be provided. The slot-shaped recesses 127 in the partial covering 12 are slightly deeper than the locking tongues 121 are wide. The locking tongues 121 are provided on the partial covering 12 slightly inwardly offset from the back edge of the partial covering 12 and are located on the inner end of the slot-shaped recesses 127.

The slot-shaped recesses 127 in the covering surface 128 of the partial covering 12 lead to increased flexibility of the covering surface 128 and, therefore, of the latching tongues 121 as well. Thus, the latching tongues 121 can execute the movement required for latching the locking noses 122 into the annular groove 61 (see FIG. 4) of the socket 6 substantially more easily than in an embodiment without slots. The insertion force which has to be applied to insert the connector 4 into the socket 6 is therefore significantly reduced. The cooperation between connector and socket is clear in FIGS. 3 and 4.

Figure 2:
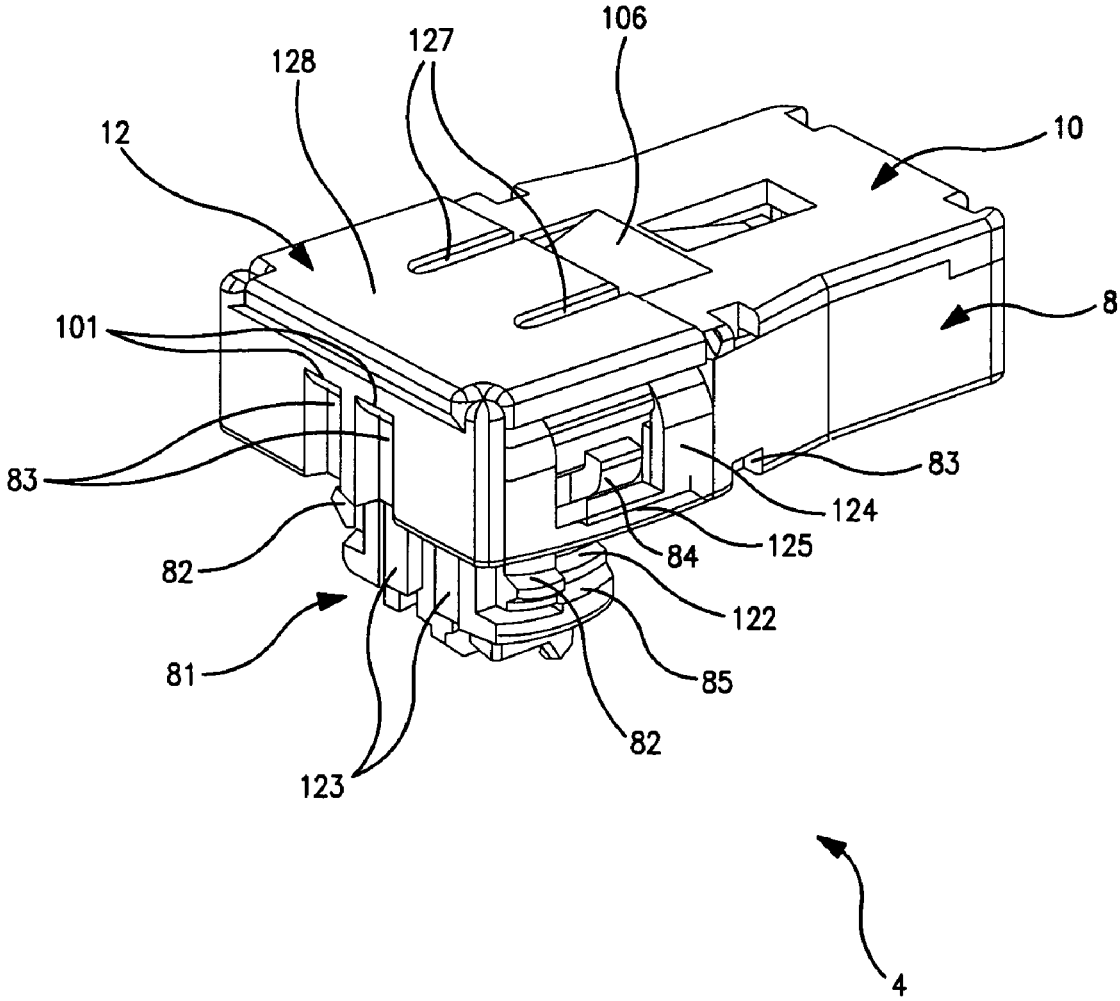
FIG. 2 shows a perspective view of an assembled connector according to an exemplary embodiment of the invention.

FIG. 2 shows an assembled connector 4. The figure shows the cooperation between the three components: housing 8, cover 10, and partial covering 12. The lateral components 124 of the partial covering 12 surround the housing cover 10 and the housing 8 and laterally latch with their latching hooks 125 on the housing 8. The locking noses 122 of the locking tongues 121 are located directly behind the locking devices 82 and above a connector element 85 of the housing 8 which is configured partially annularly, for example. The connector element 85 is used as a support for the locking tongue 121. Slot-shaped recesses 127 in the covering surface 128 of the partial covering 12 increase the flexibility of the system. Below the partial covering 12 or below the face bounded by the slot-shaped recess 127, the housing cover 10 comprises a depression 106. The depression 106 is used to introduce a tool (screwdriver) for unlocking the partial covering.

Figure 3:
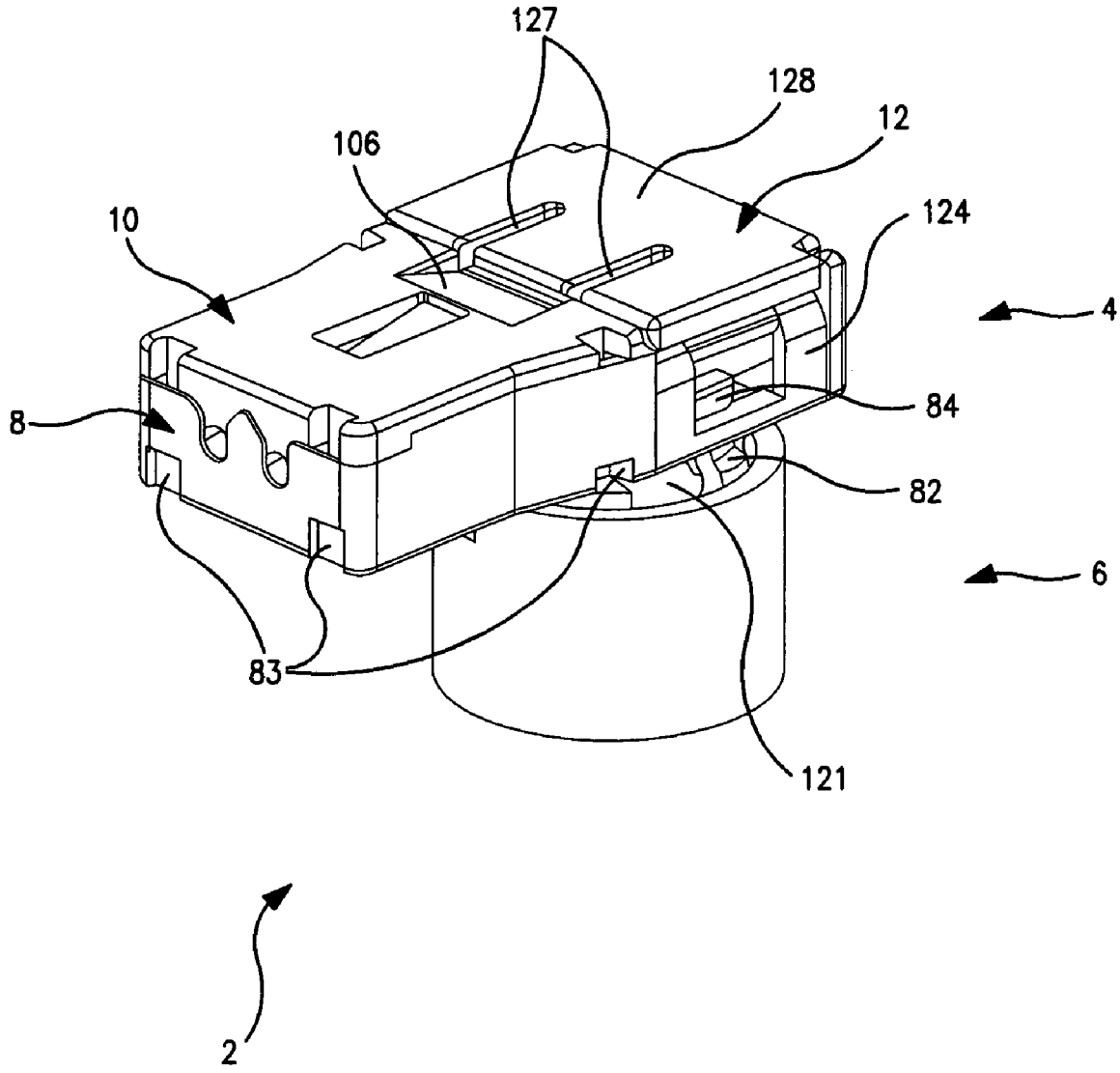
FIG. 3 shows a perspective view of a semi-locked plug-type connector according to an exemplary embodiment of the invention in a semi-locked state.

FIG. 3 shows a plug-type connector 2 according to an exemplary embodiment of the invention in the semi-locked position. The connector 4 is inserted into the socket 6 and is on the point of locking. The remaining features correspond to those which have already been described in FIG. 2.

Figure 4:
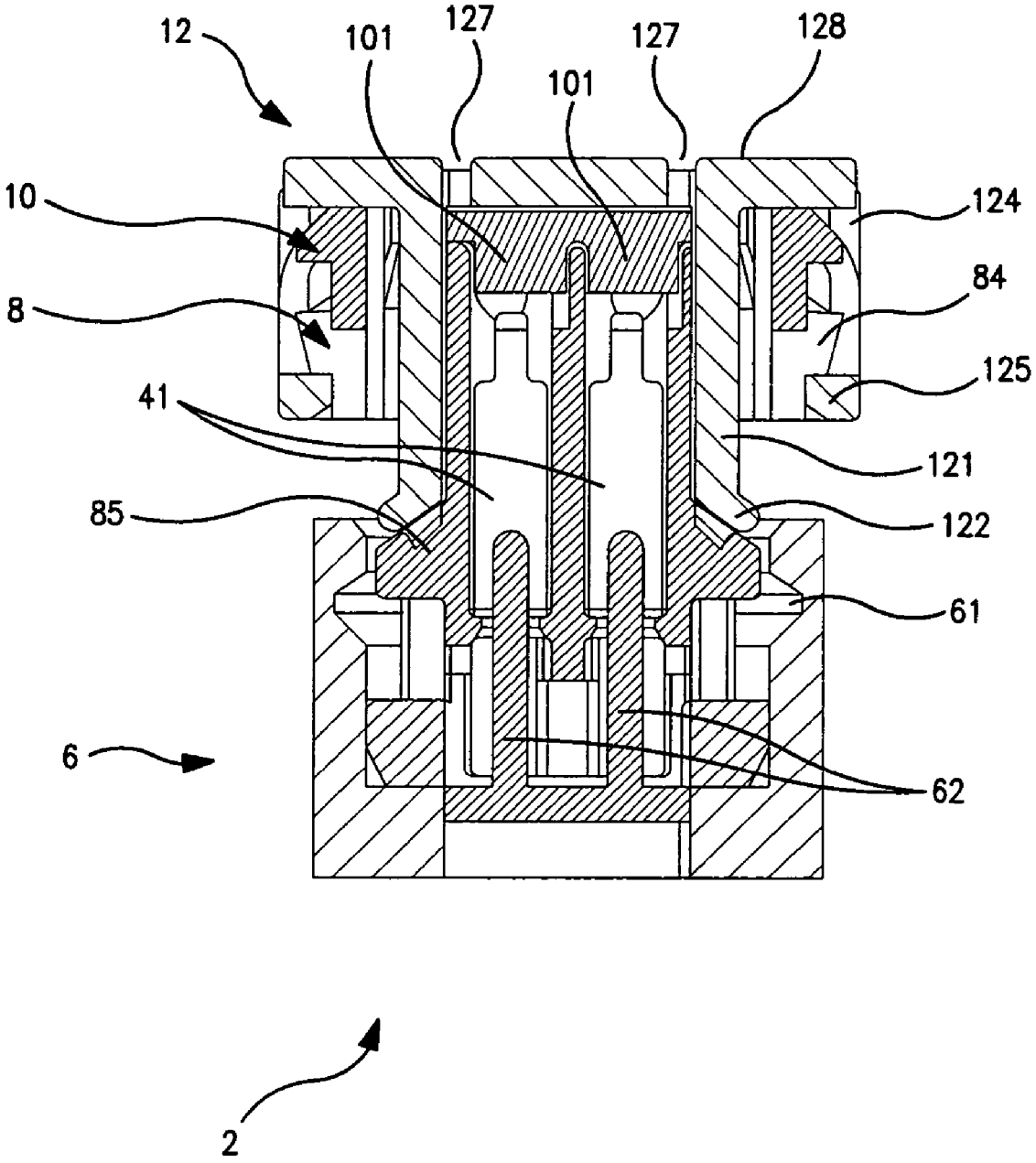
FIG. 4 shows a section of the plug-type connector of FIG. 3.

FIG. 4 shows the locking mechanism by way of a section of a plug-type connector 2. In the illustrated state the connector 4 is inserted only partially into the socket 6. Locking is not produced. The socket 6 has a peripheral annular groove 61 and contact pins 62. The contact pins 62 are surrounded by spring contacts 41 during the insertion operation. The locking noses 122 of the locking tongues 121, in the illustrated state, are not yet located in the annular groove 61. The locking tongues 121 have to move counter to the direction of plugging-in during the insertion operation to produce locking.

Figure 5:
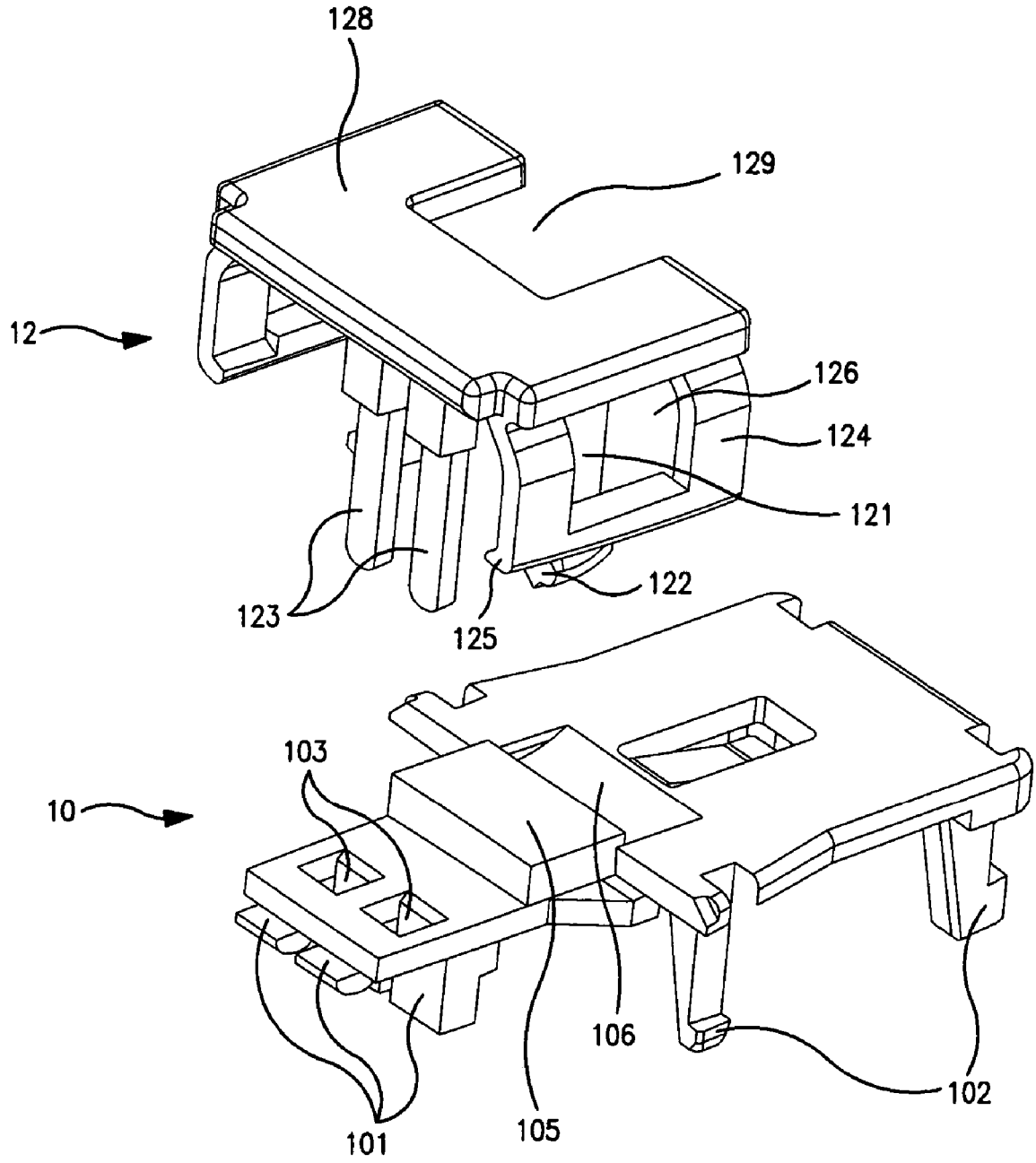
FIG. 5 shows an exploded view of a connector according to an alternate exemplary embodiment of the invention and FIG. 6 shows a perspective view of a connector according to an alternate exemplary embodiment of the invention.

FIG. 5 shows an alternative embodiment of a connector 4 according to the invention with the aid of an exploded view of the housing cover 10 and partial covering 12. The partial covering 12, according to the invention, has a planar recess 129. In the illustrated embodiment this recess is located at the backwards-pointing edge of the partial covering 12 so the back edge of the partial covering 12 is not continuous. The planar recess 129 is rectangular, one longitudinal side of the rectangle being formed by the imaginary drawn-through back edge of the partial covering, and a respective locking tongue 121 on the partial covering 12 is located on the two transverse sides of the rectangle. The flat or slightly curved inner faces of the locking tongues 121 terminate flush with the edge faces of the transverse sides. The transverse sides of the rectangular recesses 129 in the partial covering 12 are slightly longer than the locking tongues 121 are wide. The locking tongues 121 are provided on the partial covering 12 slightly inwardly offset from the back edge of the partial covering 12.

The planar recess 129 in the partial covering 12 can also be square or a different shape. It does not have to be bordered at the edges but can be let into the covering surface 128 of the partial covering 12 at any location. According to the invention, the planar recess 129 is always connected to the locking tongues 121.

The housing cover 10, in the region which comes to rest directly below the planar recess 129 in the partial covering 12 on mating, comprises a thickened region 105. In the illustrated embodiment, the thickening 105 takes place at a rectangular face which is slightly smaller than the planar recess 129, so in the assembled state, it can project through the recess. The thickening 105 can, for example, take place as a result of an increased material thickness and/or the application, for example gluing, of a layer made of a different material.

Figure 6:
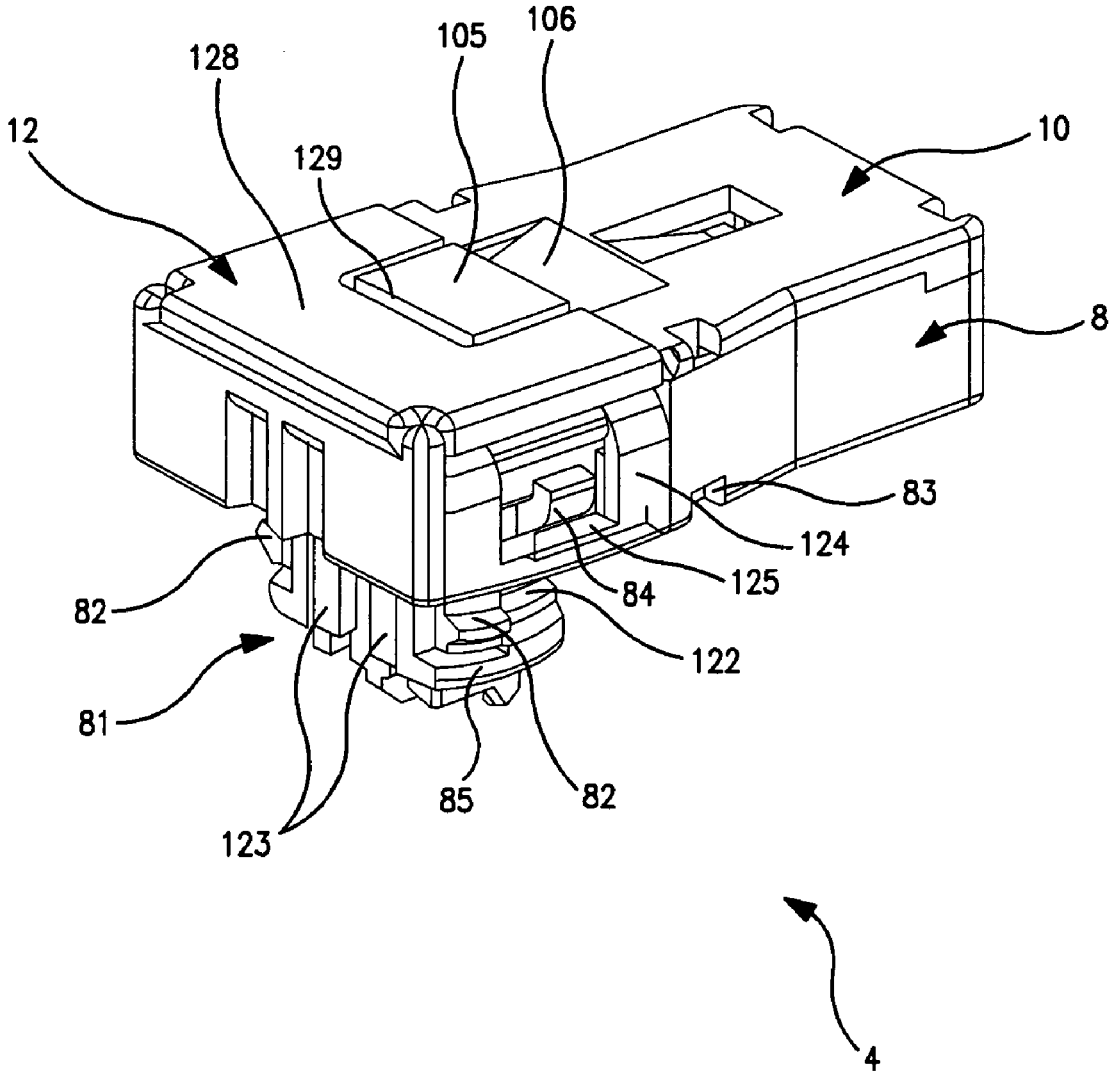

FIG. 6 shows the connector 4 with planar recess 129 in the partial covering 12 in the assembled state. On latching of the partial covering 12 on the connector housing 8, the thickened region 105 of the housing cover 10 comes to rest directly below the planar recess 129 and projects into or through the recess such that the thickened face 105 terminates level or slightly elevated with respect to the plane of the covering surface 128 of the partial covering 12.

At least partial decoupling of the movements of the locking tongues 121 of the partial covering 12 and the movement of the remaining connector 4 or the remaining partial covering 12 is also provided in this embodiment of the present invention.

A particular further advantage of this embodiment of the present invention is that it provides the possibility of introducing the insertion force for producing the locked plug-type connector 2 according to the invention via the housing cover 10 instead of via the partial covering 12. In the event of pressure on the partial covering 12, the freedom of movement of the partial covering 12 and the locking tongues 121 is limited, and this increases the insertion force. The movement is not limited if the insertion force is introduced via the thickened face 105 of the housing cover 10. The flexibility of the partial covering 12 and the locking tongues 121, thus increased again during the insertion operation, leads to a further reduction in the requisite insertion force.

The features of the invention disclosed in the description above, the drawings and the claims can be important for achieving the invention in its various configurations both individually and in any combination. The invention is not limited to the above embodiments, rather a large number of variations and modifications are conceivable within the scope of the invention.

What is claimed is:

1. A lockable plug-type connector, comprising:

a connector substantially comprising a housing with a connecting device and a first locking device, a housing cover and a partial covering with at least one recess and a second locking device, the at least one recess extending through the partial covering from an inner surface to an outer surface located opposite from the inner surface; and a socket for lockably receiving the connecting device located on the connector;

the first and second locking devices providing mechanical locking of the connector in the socket;

the second locking device of the partial covering being formed by at least one locking tongue which is arranged on an edge of the at least one recess on the partial covering.

2. The lockable plug-type connector according to claim 1, wherein at least the partial covering is manufactured from a flexible material.

3. The lockable plug-type connector according to claim 1, wherein the connecting device comprises a partially annular connector element, and the at least one locking tongue is radially supported on the connector element.

4. The lockable plug-type connector according to claim 1, wherein the at least one recess on the partial covering is located at a back edge of the partial covering so that the back edge of the partial covering is non-continuous.

5. The lockable plug-type connector according to claim 1, wherein at least one inner face of the at least one locking tongue terminates flush with an edge face of the at least one recess on the partial covering.

6. The lockable plug-type connector according to claim 1, wherein the at least one recess on the partial covering is slot-shaped.

7. The lockable plug-type connector according to claim 6, wherein the at least one recess on the partial covering is flush with at least one inner face of the at least one locking tongue.

8. The lockable plug-type connector according to claim 6, wherein the at least one recess on the partial covering extends up to a backwards-pointing edge of the partial covering.

9. The lockable plug-type connector according to claim 6, wherein the at least one recess on the partial covering corresponds in its depth to at least a width of the at least one locking tongue.

10. The lockable plug-type connector according to claim 1, wherein the at least one recess on the partial covering is planar.

11. The lockable plug-type connector according to claim 10, wherein the at least one recess on the partial covering is flush with at least one inner face of the at least one locking tongue.

12. The lockable plug-type connector according to claim 10, wherein the at least one recess of the partial covering extends up to a backwards-pointing edge of the partial covering.

13. The lockable plug-type connector according to claim 10, wherein a portion of the housing of the connector projects from an upper side of the partial covering when the portion is received in the at least one recess.

14. The lockable plug-type connector according to claim 13, wherein the portion of the housing of the connector is a thickened portion of the housing cover.

15. The lockable plug-type connector according to claim 13, wherein the portion of the housing projecting from the upper side of the partial covering corresponds in its shape to a shape of the at least one recess on the partial covering.

* * * * *